US007696975B2

(12) United States Patent
Yang et al.

(10) Patent No.: US 7,696,975 B2
(45) Date of Patent: Apr. 13, 2010

(54) LIQUID CRYSTAL DISPLAY HAVING DISPLAY BLOCKS THAT DISPLAY NORMAL AND COMPENSATION IMAGES

(75) Inventors: Hui-Wen Yang, Tainan (TW); Chia-Ho Yang, Kaohsiung (TW)

(73) Assignee: Chi Mei Optoelectronics Corporation, Tainan (TW)

( * ) Notice: Subject to any disclaimer, the term of this patent is extended or adjusted under 35 U.S.C. 154(b) by 1198 days.

(21) Appl. No.: 11/256,661

(22) Filed: Oct. 21, 2005

(65) Prior Publication Data

US 2006/0164380 A1 Jul. 27, 2006

(30) Foreign Application Priority Data

Jan. 21, 2005 (TW) ..... 94101921 A

(51) Int. Cl.
*G09G 3/36* (2006.01)

(52) U.S. Cl. ..... 345/100; 345/98

(58) Field of Classification Search ..... 345/87, 345/89, 94, 100, 103, 104, 98
See application file for complete search history.

(56) References Cited

U.S. PATENT DOCUMENTS 4,317,115 A * 2/1982 Kawakami et al. ..... 345/94
6,473,077 B1 * 10/2002 Takenaka et al. ..... 345/209
6,693,618 B2 2/2004 Son et al.
6,816,142 B2 * 11/2004 Oda et al. ..... 345/89
7,164,405 B1 * 1/2007 Jeong et al. ..... 345/94
7,400,306 B2 * 7/2008 Hu ..... 345/1.3
2001/0003448 A1 * 6/2001 Nose et al. ..... 345/99
2002/0044246 A1 4/2002 Moon et al.
2002/0063671 A1 5/2002 Knapp
2003/0006948 A1 1/2003 Son et al.
2003/0218587 A1 11/2003 Ikeda
2003/0227428 A1 12/2003 Nose
2004/0001054 A1 * 1/2004 Nitta et al. ..... 345/204
2005/0246433 A1 * 11/2005 Carrigan et al. ..... 709/223

FOREIGN PATENT DOCUMENTS

JP 9127917 5/1997
JP 2004/012872 1/2004
WO 2004/017128 2/2004

OTHER PUBLICATIONS

Nakamura et al., "Late-News Paper: A Novel Wide-Viewing-Angle Motion-Picture LCD," SID 98, 11.5L (1998).

* cited by examiner

*Primary Examiner*—Chanh Nguyen
*Assistant Examiner*—Ram A Mistry
(74) *Attorney, Agent, or Firm*—Fish & Richardson P.C.

(57) ABSTRACT

A liquid crystal display includes an active display area and gate drivers. The active display area includes display blocks, each display block including pixel rows. The gate driver sequentially outputs gate signals to the display block and drives corresponding pixel rows to display pixel images, or outputs a dummy gate signal to the display block to drive the corresponding pixel rows to display a compensation image for improving motion image quality. A method of driving the liquid crystal display includes using the gate drivers to sequentially drive the pixel rows of each of the display blocks to display pixel images, and using the gate driver to output a dummy gate signal to simultaneously drive the pixel rows of another display block to display the compensation image.

8 Claims, 12 Drawing Sheets

LIQUID CRYSTAL DISPLAY HAVING DISPLAY BLOCKS THAT DISPLAY NORMAL AND COMPENSATION IMAGES

CROSS-REFERENCE TO RELATED APPLICATIONS

This application claims priority to Taiwan application serial no. 94101921, filed Jan. 21, 2005, the content of which is incorporated by reference.

BACKGROUND OF THE INVENTION

1. Field of the Invention

The invention relates in general to a liquid crystal display and a method for driving the display, and more particularly to a liquid crystal display having improved motion image quality, and a method for driving the display.

2. Description of the Related Art

Common displays can be classified into two types depending on the method for displaying images: an impulse type and a hold type. A cathode ray tube (CRT) display is an example of a conventional impulse-type display. In a CRT display, electrons are accelerated in a vacuum tube and collide with phosphor powder coated on the wall of the vacuum tube, causing the phosphor powder to emit light for displaying images. As shown in FIG. 1A, the intensity of the light gradually decays during each frame period, so that the brightness of the image is maintained for only a few milliseconds. In another example, a liquid crystal display (LCD) is a hold-type display. As shown in FIG. 1B, within each frame period, an image is shown when pixel data are written to the pixels, and the brightness of the image is maintained for an entire frame period until the next pixel data are written to the pixels.

In general, when a liquid crystal display is displaying motion images, due to its hold-type display mode, some parts of the display area will display a portion of a new frame while other parts of the display area (where new image data have not been written to the pixels) will continue to show a portion of a previous frame. When the liquid crystal display is viewed by an observer, because the display area shows a portion of a new frame and a portion of a previous frame, and because human eyes track motion images, the observed motion images will have blurred edges and residual images, thereby reducing the image quality.

To solve the problems mentioned above, typically a black image is inserted in the image display process of an LCD display to achieve an effect similar to that of a CRT display, thus improving the motion image quality. As shown in FIGS. 2A and 2B, a frame period is divided into a first sub-frame period and a second sub-frame period. During the first sub-frame period, pixel data voltages are used to drive pixels to cause the pixels to display a normal image. During the second sub-frame period, a black image is inserted by using black image voltages to drive the pixels. The black image is shown until pixel data for the next frame period are written to the pixels to cause a new normal image to be displayed. The display mode for the LCD display as shown in FIG. 2B is more similar to the display mode for a CRT shown in FIG. 1A.

Below are examples of methods for inserting a black image. In one example, black images are generated by flashing a backlight source. Due to the need for long periods of repeatedly switching on and off the backlight module, this method has the disadvantages of larger electricity consumption, reduced lifespan of the backlight, and higher production costs. When the timing of backlight flashing is not synchronized with the display signals of the liquid crystal display, double images can occur so that an observer sees double images at the edges of objects when watching the motion images.

Another example is a cyclic resetting driving design disclosed in U.S. Pat. No. 6,473,077, which uses a double-frequency method to insert a black image. Referring to FIG. 3, using a liquid crystal display having a 640×480 resolution as an example, a gate driver (not shown) sequentially outputs 480 gate signals G1 to G480 during a first half of a frame period to drive corresponding rows of pixels to receive pixel data and display a normal image. During a second half of a frame period, the gate driver sequentially outputs 480 black image gate signals Gb1~Gb480. This allows a normal image to be displayed during the first half of the frame period, and a black image to be inserted during the second half of the frame period.

Although the motion image quality can be improved by using the method described above, twice the number of gate signals and twice the amount of image data are used so that two images can be shown within a frame period. This requires doubling an operation frequency of the liquid crystal display, which increases the cost of the scan driver and the data driver. In the double-frequency driving design, because half of the frame period is allocated to the black image gate signals Gb1 to Gb480, only half of the frame period can be allocated to the gate signals G1 to G480, so that the period for writing pixel data is also reduced by half (from TA to TA/2). This may cause the pixels to have incorrect gray levels due to insufficient charging, and there may be increased electromagnetic interference (EMI) due to higher driving frequencies.

Referring to FIG. 4A, in another example of a cyclic resetting driving method, a display panel is divided into a matrix panel region A and a matrix panel region B that are coupled to data drivers 4 and 5, respectively. Referring to FIG. 4B, in a first half of a frame period, a gate driver 6 sequentially outputs gate signals G1 to G240 to drive the pixel rows in the matrix panel region A to receive pixel data outputted from the data driver 4 to display an image. In a second half frame period, the gate driver 6 sequentially outputs gate signals G241 to G480 to drive pixel rows in the matrix panel region B to receive pixel data output from the data driver 5 to display an image. Also during the second half frame period, the gate driver 6 sequentially outputs black image gate signals Gb1 to Gb240 to drive the pixel rows in the matrix panel region A to receive black image signals outputted from the data driver 4 to display a black image. Using this signal driving method, although the duration of each of the gate signals G1 to G480 remains the same as the original TA value, dividing the liquid crystal panel into two parts that are coupled to different data drivers increases complexity of the driving circuits and the manufacturing cost of the display.

A third example of a liquid crystal display is disclosed in Japanese Patent No. 9127917. Referring to FIG. 5, each pixel 500 is coupled to data lines Ld1 and Ld2 that are coupled to outputs of data drivers 510 and 520, respectively. Each pixel 500 is also coupled to scan lines Ls1 and Ls2 that are coupled to gate drivers 530 and 540, respectively. A normal gate signal Sg is transmitted through the scan line Ls1 to drive the pixel 500 so that the pixel 500 receives normal pixel data Dp from the data line Ld1 to display a pixel image. A black image gate signal Sd is then transmitted through the scan line Ls2 to drive the pixel 500 to receive a black signal Db from the data line Ls2 to display a black image. This method adds a scan line and a data line to each row and column of pixels, respectively, and will increase the production cost of the display and reduce the aperture ratio of the pixel.

SUMMARY OF THE INVENTION

In general, in one aspect, the invention features a liquid crystal display (and a method of driving the display) that includes an active display area having display blocks. After pixel images are displayed in one display block, a gate driver outputs a dummy gate signal to drive all the pixel rows in another display block to display a compensation image for improving motion images. The compensation image can be, for example, a black image. In some examples, the dummy gate signal can be applied during a blanking time defined by the VESA standard. The motion image quality can be improved without changing the operational frequency or using extra gate drivers and data drivers.

In general, in another aspect, the invention features a liquid crystal display that includes an active display area and at least one gate driver. The active display area includes display blocks, each display block including pixel rows. The gate driver sequentially outputs gate signals to the display blocks to drive corresponding pixel rows to display pixel images. The gate driver outputs a dummy gate signal to each display block to drive all of the corresponding pixel rows to display a compensation image for improving motion image quality. After the pixel rows of one display block are sequentially driven by corresponding gate signals to display pixel images, the pixel rows of another display block are simultaneously driven by a corresponding dummy gate signal to display the compensation image for improving motion image quality.

In general, in another aspect, the invention features a liquid crystal display that includes an active display area, gate drivers, and a timing controller. The active display area includes display blocks, and each display block includes pixel rows. Each gate driver sequentially outputs gate signals to the display blocks to drive pixel rows to display pixel images. The gate driver also receives a control signal from the timing controller, upon which the gate driver simultaneously outputs dummy gate signals to a display block to drive the pixel rows to display a compensation image to improve the motion image quality. After one gate driver sequentially outputs gate signals to drive a corresponding display block to display pixel images, the timing controller controls another gate driver to simultaneously output dummy gate signals to drive another corresponding display block to display a compensation image to improve the motion image quality.

In general, in another aspect, the invention features a method for driving a liquid crystal display, including dividing an active display area into display blocks, each display block including pixel rows. A gate driver sequentially drives the pixel rows of the display blocks to display pixel images, in which after the gate driver sequentially drives the pixel rows of one of the display blocks to display pixel images, the gate driver drives another one of the display blocks to display a compensation image to improve the motion image quality.

In general, in another aspect, the invention features a method for driving a liquid crystal display, including controlling gate drivers to sequentially drive the pixel rows of corresponding display blocks to display pixel images, in which after controlling one of the gate drivers to sequentially drive the pixel rows of a corresponding display block to display pixel images, controlling another one of the gate drivers to drive the pixel rows of another display block to display a compensation image to improve motion image quality.

Other objects, features, and advantages of the invention will become apparent from the following description, and the claims. The following description is made with reference to the accompanying drawings.

DETAILED DESCRIPTION OF THE INVENTION

Two examples of liquid crystal displays are described to show how to insert compensation images to improve motion image quality.

THE FIRST EXAMPLE

Figure 1A:
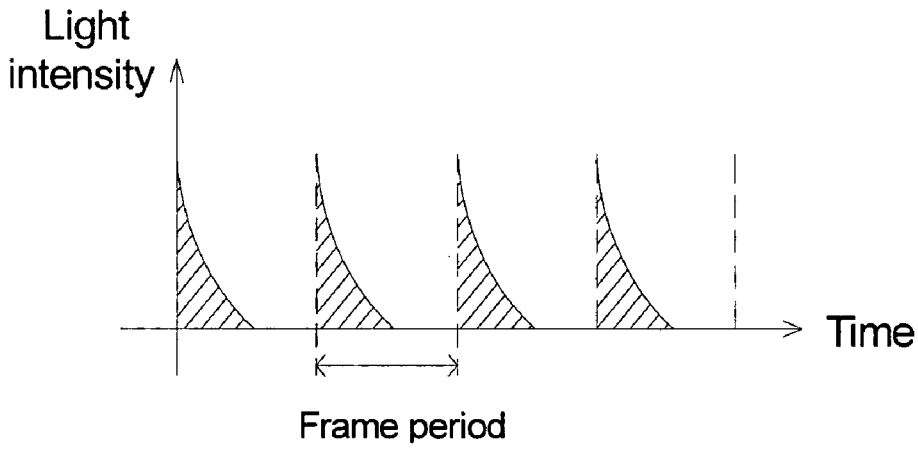
FIG. 1A(PRIOR ART)
FIG. 1A is a diagram representing the display mode of a conventional cathode ray tube.
Figure 1B:
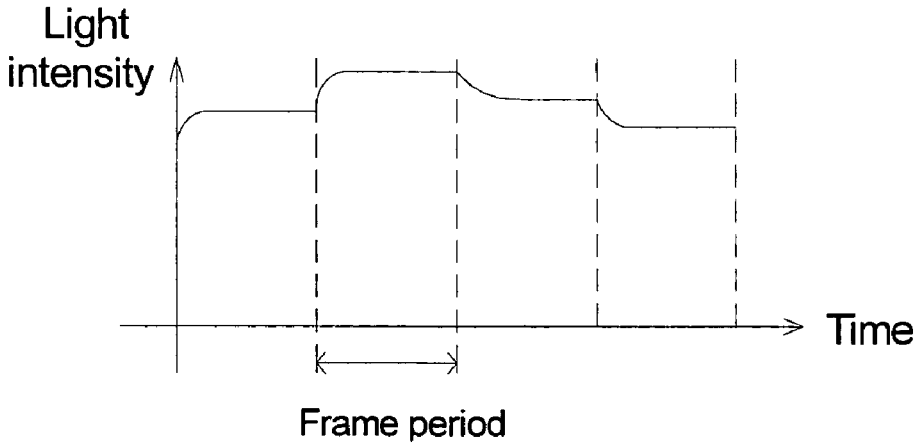
FIG. 1B(PRIOR ART)
FIG. 1B is a diagram representing the display mode of a conventional LCD display.
Figure 2A:
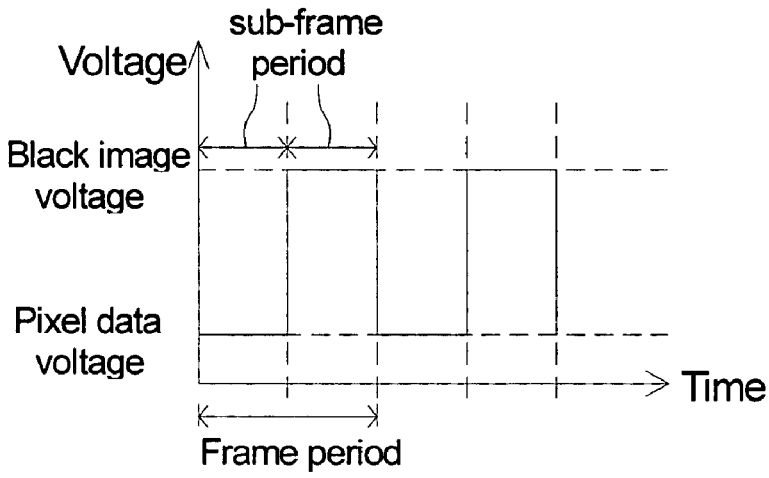
FIG. 2A is a diagram of a voltage signal over time.
Figure 2B:
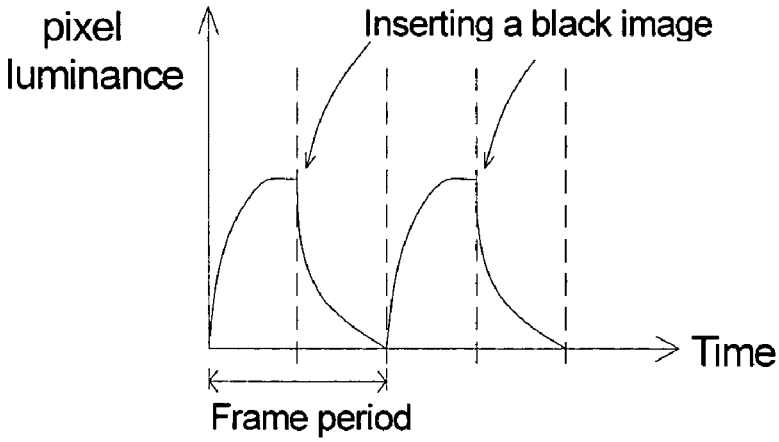
FIG. 2B is a time diagram showing pixel luminance of a liquid crystal display with black images inserted between normal images.
Figure 3:
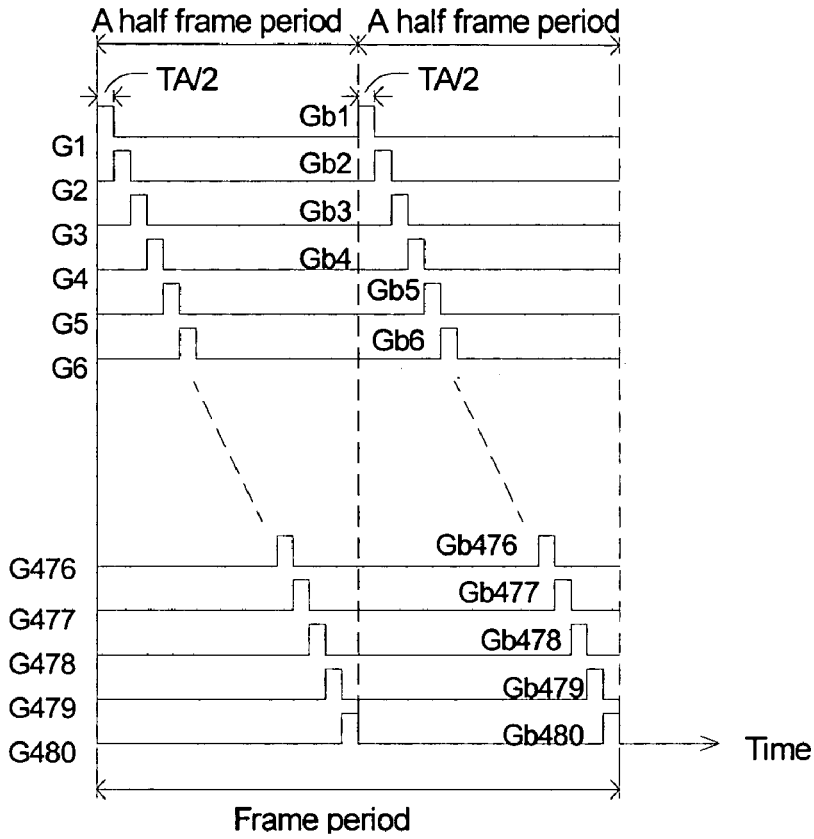
FIG. 3(PRIOR ART)
FIG. 3 is a time diagram of gate signals in a liquid crystal display with black image gate signals inserted in a frame period, as disclosed in U.S. Pat. No. 6,473,077.
Figure 4A:
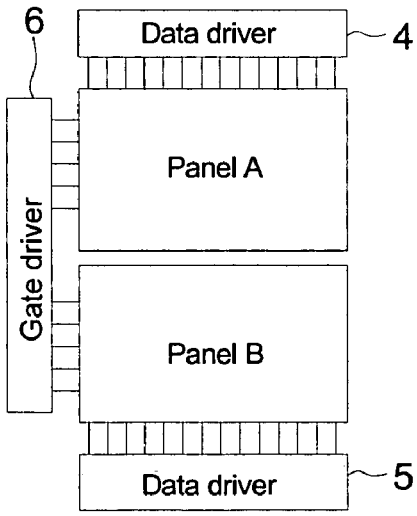
FIG. 4A(PRIOR ART)
FIG. 4A is a block diagram of the structure of a liquid crystal display disclosed in U.S. Pat. No. 6,473,077.
Figure 4B:
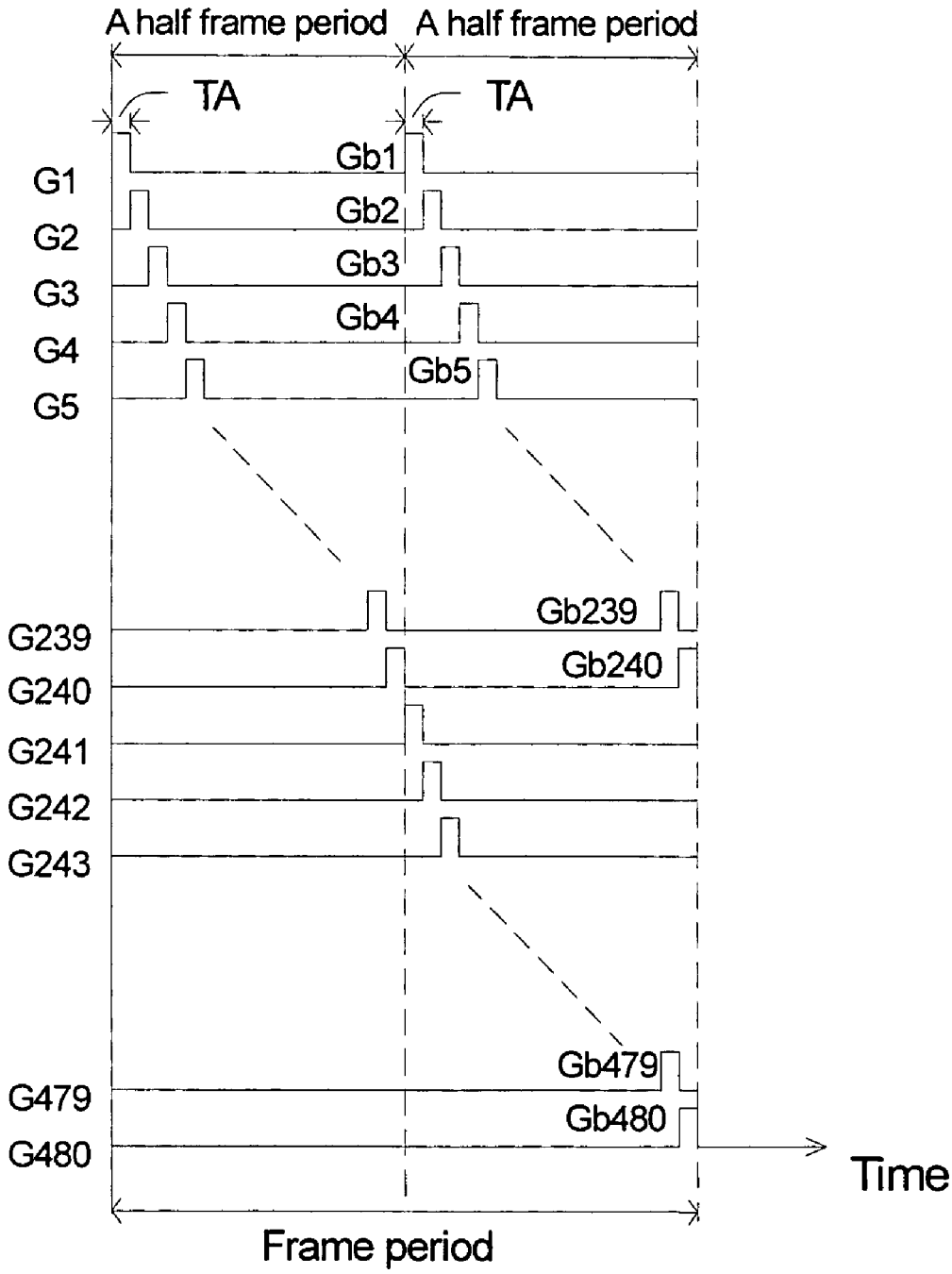
FIG. 4B(PRIOR ART)
FIG. 4B is a time diagram of black image gate signals that are inserted in a second half of a frame period in the liquid crystal display of FIG. 4A.
Figure 5:
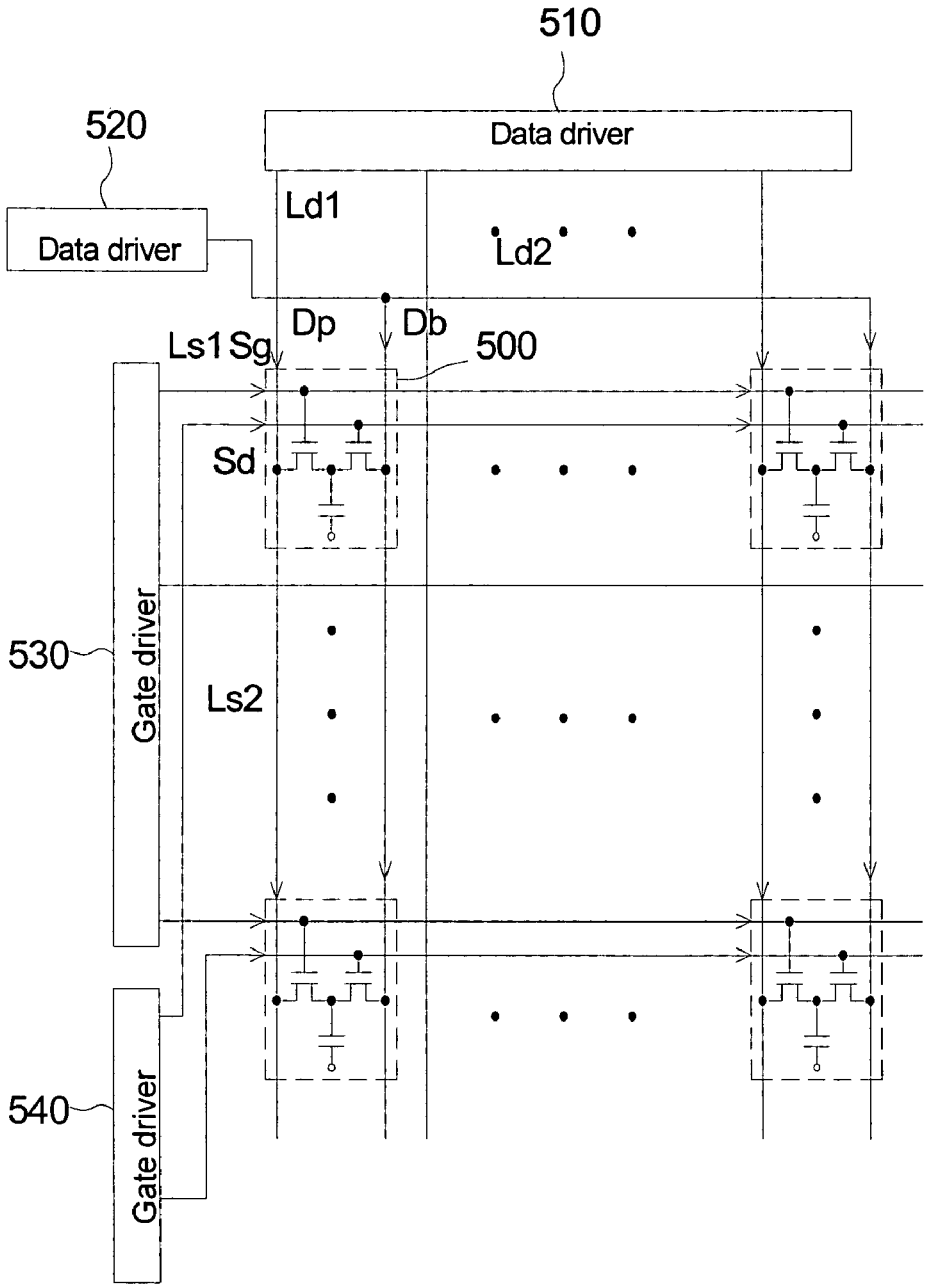
FIG. 5 is a block diagram of the structure of a liquid crystal display disclosed in Japanese Patent No. 9-127917.
Figure 6A:
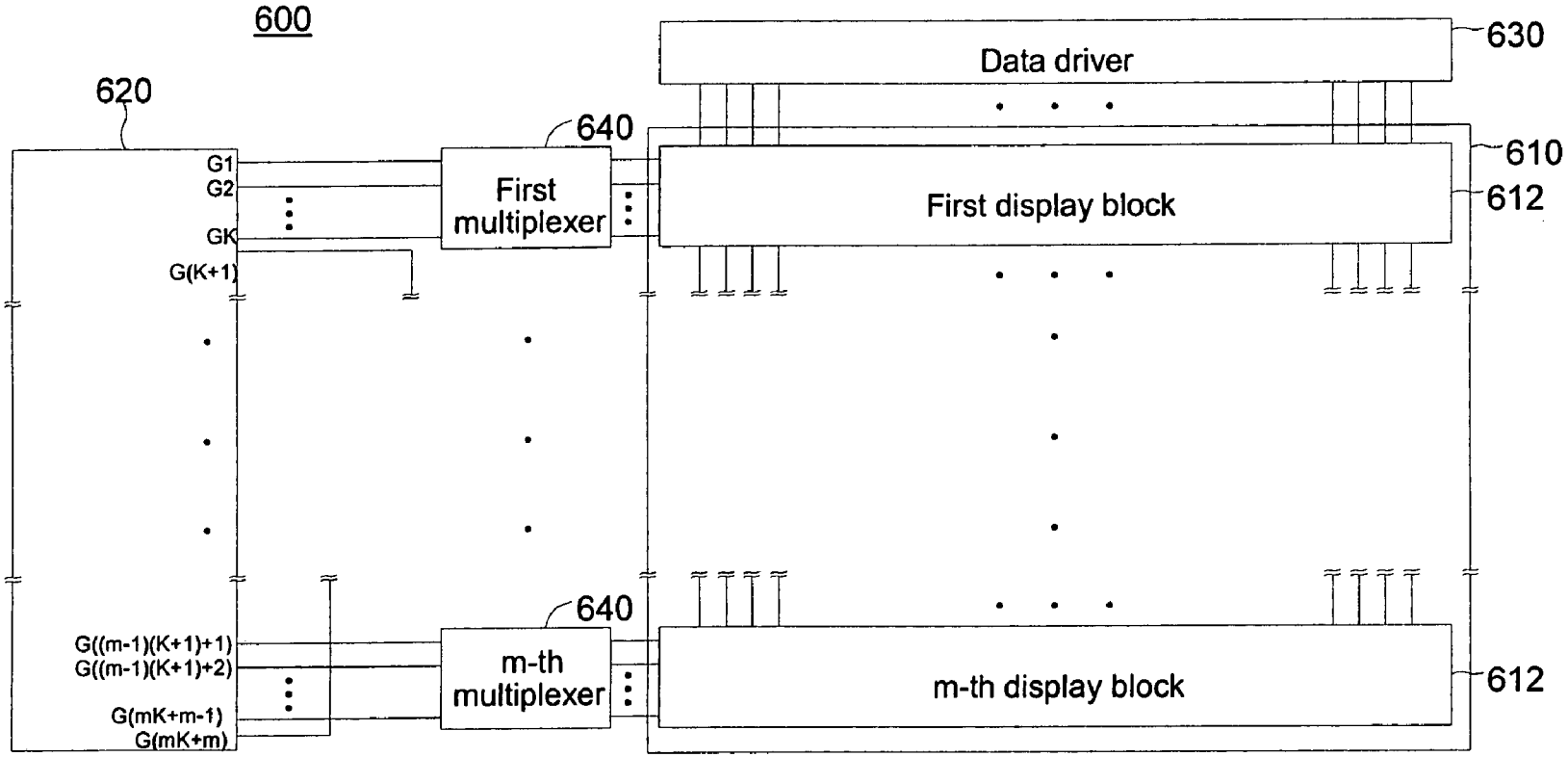
FIG. 6A is a block diagram of the structure of a liquid crystal display.

FIG. 6A shows a schematic diagram of an example of a liquid crystal display 600. The liquid crystal display 600 includes an active display area 610, a gate driver 620, and a data driver 630. The active display area 610 is divided into m display blocks (or regions) 612, including a first display block 612, . . . , and an m-th display block 612, that are coupled to the gate driver 620 through a first multiplexer 640, . . . , and an m-th multiplexer 640, respectively. Each display block 612 includes k pixel rows (not shown in the figure), in which m and k are positive integers larger than 1. For example, a 640×480 liquid crystal display 600 has 480 pixel rows 214. If the active display area 610 is divided into 40 display blocks 612, each display block 612 will have 12 pixel rows.

The gate driver 620 sequentially outputs (m(k+1)) gate signals (or gate pulses) G1, G2, . . . , and G(m(k+1)) to the active display area 610. The gate signals G1~Gk, . . . , G((p−

1)(k+1)+1)~G(p(k+1)−1) (not shown in the figure), . . . , and G((m−1)(k+1)+1)~G(m(k+1)−1) are normal gate signals that sequentially drive the k pixel rows of the first to m-th display blocks to display pixel images. The gate signals G(k+1), . . . , G(p(k+1)) (not shown in the figure), . . . , and G(m(k+1)) are dummy gate signals that are sent to the display blocks 612 through multiplexers 640 to. Each of the dummy gate signals G(k+1), . . . , G(p(k+1)) simultaneously drives all pixel rows of a display block 612 to receive compensation image signals from the data driver 630, causing the pixel rows to show a compensation image. The compensation image signals can be, e.g., zero gray level voltage signals, which cause the pixel rows to show a black image.

Figure 6B:
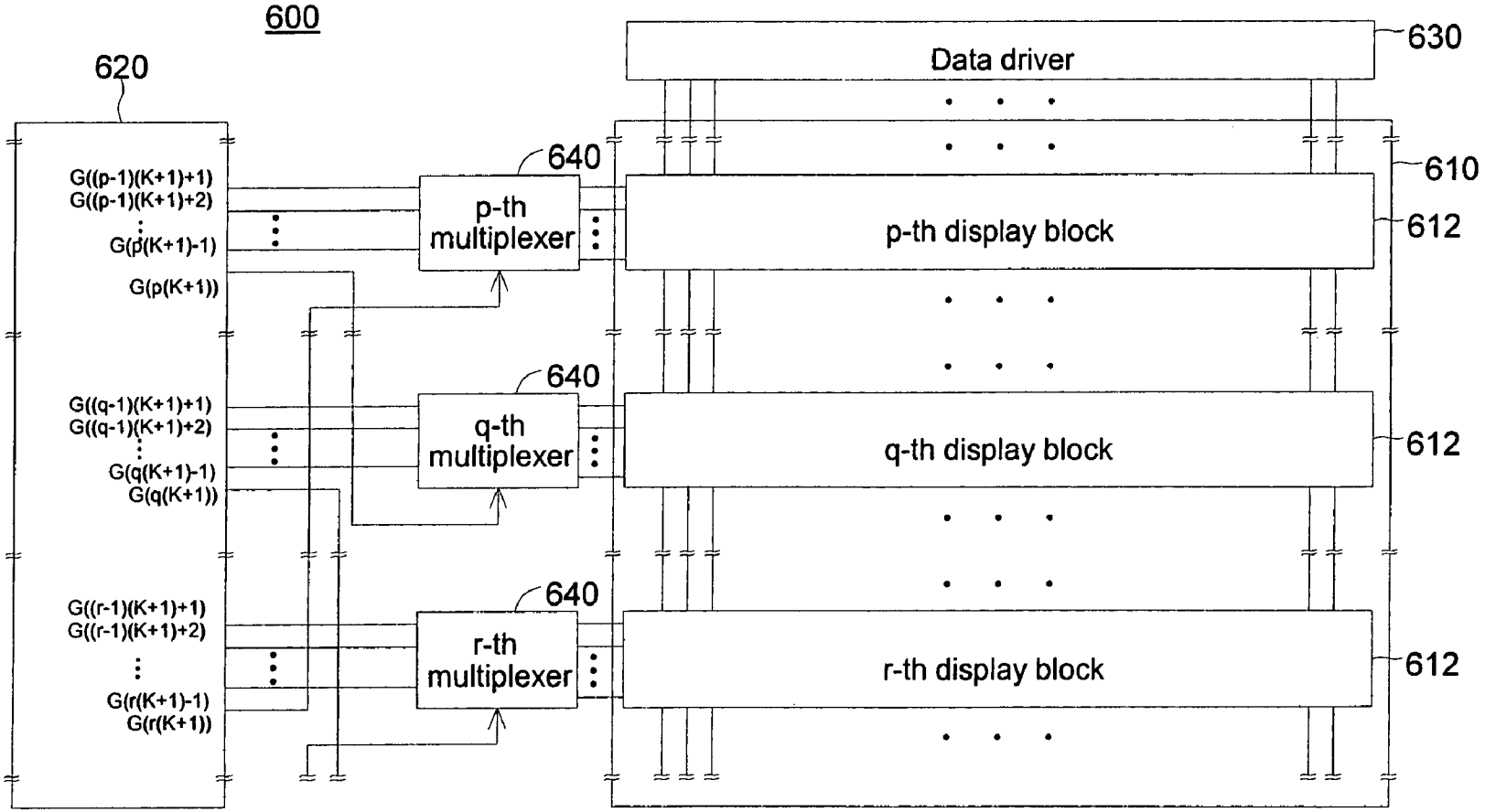
FIG. 6B is a diagram showing a gate driving circuit of FIG. 6A driving display blocks through multiplexers.

FIG. 6B shows a schematic diagram of the display 600 that includes a p-th display block 612, a q-th display block 612, and an r-th display block 612, which are driven by the gate driver 620 through a p-th multiplexer 640, a q-th multiplexer 640, and an r-th multiplexer 640, respectively. A dummy gate signal G(p(k+1)) is sent to the q-th multiplexer 640, and a dummy gate signal G(r(k+1)) is sent to the p-th multiplexer 640.

Figure 6C:
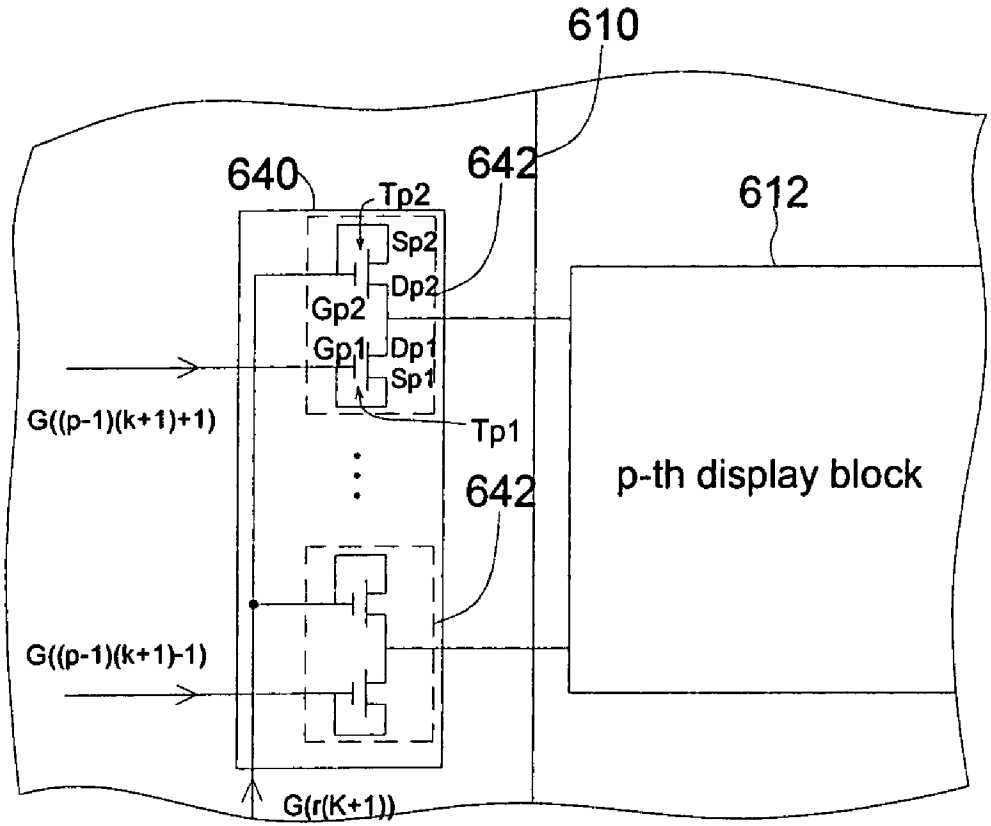
FIG. 6C shows a circuit diagram of a multiplexer of FIG. 6B.

Referring to FIG. 6C, the p-th, q-th, and r-th (p≠q and p≠r) multiplexers 640 each includes k transistor sets 642 for coupling to the k pixel rows of the p-th, q-th, and r-th display blocks 612, respectively. Each transistor set 642 of the p-th multiplexer 640 includes a first N-type metal oxide semiconductor (NMOS) transistor Tp1 and a second NMOS transistor Tp2. The transistor Tp1 includes a gate Gp1, a drain Dp1, and a source Sp1. The transistor Tp2 includes a gate Gp2, a drain Dp2, and a source Sp2.

In the p-th multiplexer 640, the gates Gp1 of transistors Tp1 receive the gate signals G((p−1)(k+1)+1), . . . , and G(p(k+1)−1). The gates Gp2 of the transistors Tp2 receive the dummy gate signal G(r(k+1)). In the transistor Tp1, the source Sp1 is connected to the gate Gp1. In the transistor Tp2, the source Sp2 is connected to the gate Gp2. In each transistor set 642, the drain Dp1 of the transistor Tp1 and the drain Dp2 of the transistor Tp2 are both connected to a corresponding pixel row 214 of the p-th display block 612.

In the examples above, each transistor set 642 of the multiplexer 640 includes two NMOS transistors. In other examples, the transistor set 642 of the multiplexer 640 can include a combination of transistors, or combinations of other types of transistors, such as a combination of a NMOS transistor and a PMOS transistor.

The gate signals G((p−1)(k+1)+1), . . . , and G(p(k+1)−1) provide high-level voltages to switch on the transistors Tp1 of corresponding transistor sets 642, causing the gate signals to be sent to the corresponding pixel rows of the p-th display block 612 through the drains Dp1. The dummy gate signal G(r(k+1)) provides a high-level voltage to switch on the transistors Tp2 of all the transistor sets 642 in the p-th multiplexer, causing the gate signal to be sent to all of the pixel rows of the p-th display block 612 through the drains Dp2.

Figure 6D:
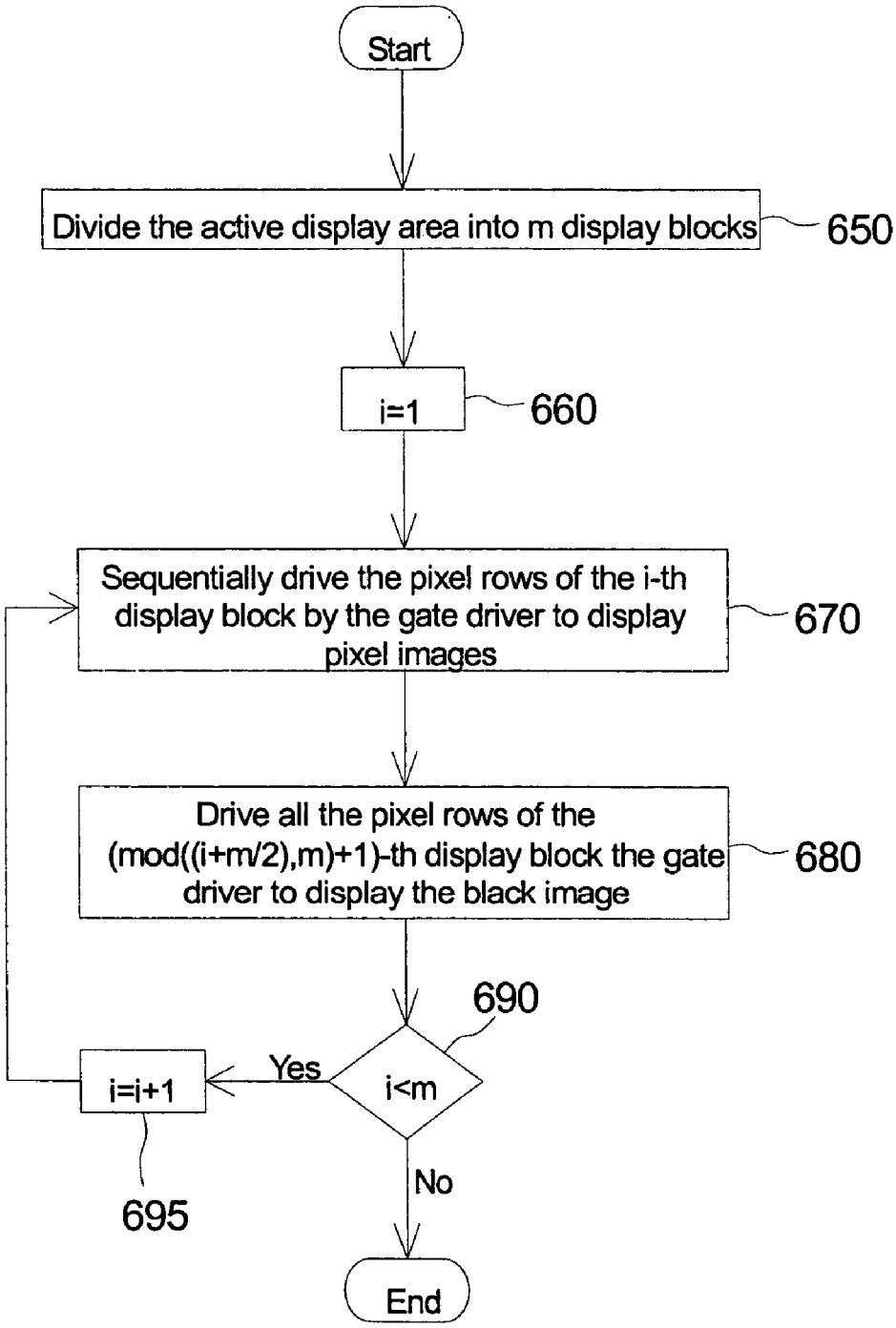
FIG. 6D is a flow diagram of a method for driving a liquid crystal display.

FIG. 6D shows a flow diagram of a process for driving a liquid crystal display during a frame period according to the first example described above. In step 650, divide the active display area 610 into m display blocks 612, in which each display block includes k pixel rows 214, and m, k are positive integers larger than 1. In step 660, set i=1. In step 670, use the output of the gate driver 620 to sequentially drive the k pixel rows 214 of the i-th display block 612 to display pixel images. In step 680, use the output of the gate driver 620 to drive all of the pixel rows 214 of the (mod((i+m/2),m)+1)-th display block 612 to display a compensation image.

The formula (mod((i+m/2),m)+1) for determining a display block is merely an example that is used when the duty ratio is 50%. A person skilled in the art can modify the value for m/2 to adjust the duty ratio. In step 690, evaluate the value of i to determine whether i is smaller than m. If the value of i is smaller than m, then in step 695, increment the value of i (i=i+1) and return to the step 670. If the value i is not smaller than m, end the process, upon which a complete image frame has been displayed within an image display frame period.

Figure 6E:
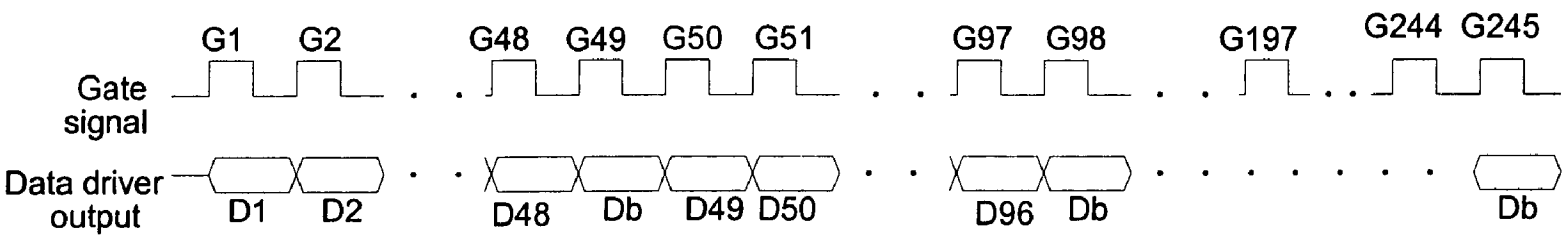
FIG. 6E is a diagram showing gate signals and data driver output signals of the liquid crystal display of FIG. 6A.

FIG. 6E shows the relationship between the gate signal and the data driver output of the liquid crystal display 600 in FIG. 6A. Using a liquid crystal display 600 having a resolution of 640×480 as an example, the active display area 610 is divided into 10 display blocks 612 (m=10), each display block 612 having 48 pixel rows (k=48). A parameter q is defined as q=mod((p+5), 10)+1.

The gate driver 620 sequentially outputs gate signals G1 to G48 to activate (turn on) the 48 pixel rows of the first display block 612 to receive pixel data D1 to D48 from the data driver 630 and to display corresponding pixel images. The gate driver 620 then outputs a dummy gate signal G49 to the seventh display block, to simultaneously activate the 48 pixel rows of the seventh display block 612 to receive the compensation image signal, such as a zero gray level voltage signal Db, from the data driver 630 to display a black image.

The gate driver 620 outputs gate signals G50~G97 to activate corresponding pixel rows of the second display block 612 to receive pixel data D49 to D96 from the data driver 630 to display corresponding pixel images. Then, the gate driver 620 outputs a dummy gate signal G98 to the eighth display block 612 to simultaneously activate the 48 pixel rows of the eighth display block 612 to receive the zero gray level voltage signal Db from the data driver 630 to display a black image.

After the gate signals G197~G244 are sequentially sent to the pixel rows of the fifth display block 612, the gate driver 620 sends a dummy gate signal G245 to the first display block 612 to simultaneously activate the 48 pixel rows of the first display block 612, causing the pixel rows to receive the zero gray level voltage signal Db from the data driver 630 and display a black image. Other portions of the active display area 610 are activated in a similar manner to complete the display of an image frame in the active display area within a frame period.

Figure 7A:
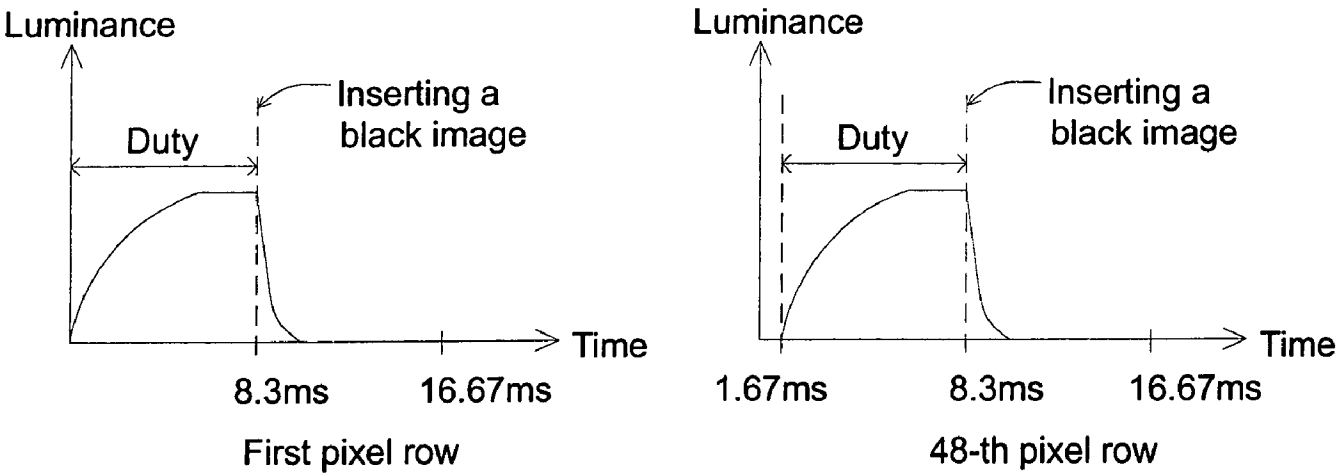
FIG. 7A shows diagrams indicating duty ratios of the first pixel row and the 48-th pixel row of a display block.

FIG. 7A shows diagrams for comparing the duty ratios of the first and k-th (k=48) pixel rows in each display block 612 of FIG. 6E The liquid crystal display 600 shows 60 image frames per second, so the display time of each frame is 16.67 ms. The active display area 610 is divided into ten display blocks 612, and the gate driver 620 outputs a total of 490 gate signals G1~G490. Among the 490 gate signals, 480 gate signals are used to drive the 480 pixel rows of the ten display blocks 612 to display pixel images, and 10 dummy gate signals (G49, G98, . . . , and G490) are used to drive the 10 display blocks 612 to display compensation images (such as black images) for improving motion image quality. The time interval between activating two adjacent pixel rows is 16.67 μs/490=34 μs.

For the first pixel row 214 of a display block, the time interval between the start of receiving pixel data and the receipt of the zero gray level voltage signal is 8.3 ms, in which the duty ratio is 8.3/16.67=50%. For the last (48-th) pixel row of a display block, the time interval between the start of receiving pixel data and receipt of the zero level voltage signal is 6.66 ms, in which the duty ratio is 6.66/16.67=40%. The difference in the duty ratios (Δduty) of the first pixel row and the last (48-th) pixel row is 10%. When the display area 610 is divided into 40 blocks, in which m=40, and k=12, the difference in duty ratios (Δduty) of the first and last pixel rows will be reduced to 2.28%. When the active display area 610 is divided into m display blocks 12, increasing the number m will reduce the difference in duty ratios (Δduty) between the first and the last pixel rows 214 of a display block, and will improve the image quality of the liquid crystal display.

Assume that the response times of the liquid crystal display for all gray levels are less than 5 ms. The first pixel row of the first display block 612 receives the zero gray level voltage signal (for inserting a black image as a compensation image for improving motion image quality) after the last pixel row of the fifth display block 612 is activated (to receive pixel data to display pixel images). The fifth display block 612 is spaced apart from the first display block 612 by one-half of the whole active display area 610. The interval between activation of the first pixel row of the first display block 612 (to display pixel images) and receipt of the zero gray level voltage signal (to display a black image) is 8.33 ms, which is greater than 5 ms. Therefore, inserting a black image after an interval of five display blocks 612 will not cause inaccurate gray levels due to insufficient luminance caused by insufficient liquid crystal response time.

As described above, if the interval between the time when the first pixel row of the p-th display block 612 receives the gate signal G((p−1)(k+1)+1) to display pixel images, and the time when the first pixel row receives the dummy gate signal G(r(k+1)) to display a black image, is equal to one-half of the time required to display a complete image on the entire active display area 610, the duty ratio would be about 50%. If the interval between the time when the first pixel row of the p-th display block 612 receives the gate signal G((p−1)(k+1)+1) to display a pixel image, and the time when the first pixel row receives the dummy gate signal G(r(k+1)) to display a black image, is equal to ⅘ of the time required to display a complete image on the entire active display area 610, the duty ratio would be about 80%. Therefore, the duty ratio can be selected according to the requirements for improving motion image quality.

According to Video Electronics Standards Association (VESA) specification, for a 640×480 liquid crystal display 600, there are 525 gate signal intervals. In the gate signal output timing sequence, in addition to sequentially outputting 480 gate signals to the corresponding 480 pixel rows, there is typically a blanking time equivalent to 45 gate line on-periods that is reserved for use by the liquid crystal display 600 and can be used by the dummy gate signals.

When the liquid crystal display is divided into m display blocks, the number m can be selected according to the blanking time in the VESA specification. For example, if the active display area 610 of a 640×480 liquid crystal display 600 is divided into 40 display blocks 612, each display block 612 will have 12 pixel rows 214. The VESA specification specifies that the blanking time is equal to 45 gate line on-periods (period in which the gate line is turned on). Out of the 45 gate line on-periods in the blanking time, 40 gate line on-periods can be allocated for use by the 40 dummy gate signals G13, G26, . . . , G520. Therefore, the LCD motion image quality can be improved by inserting compensation images without increasing display operational frequency or reducing the duration that the gate line of each pixel row are turned on, and there will not be insufficient charging problems.

Figure 7B:
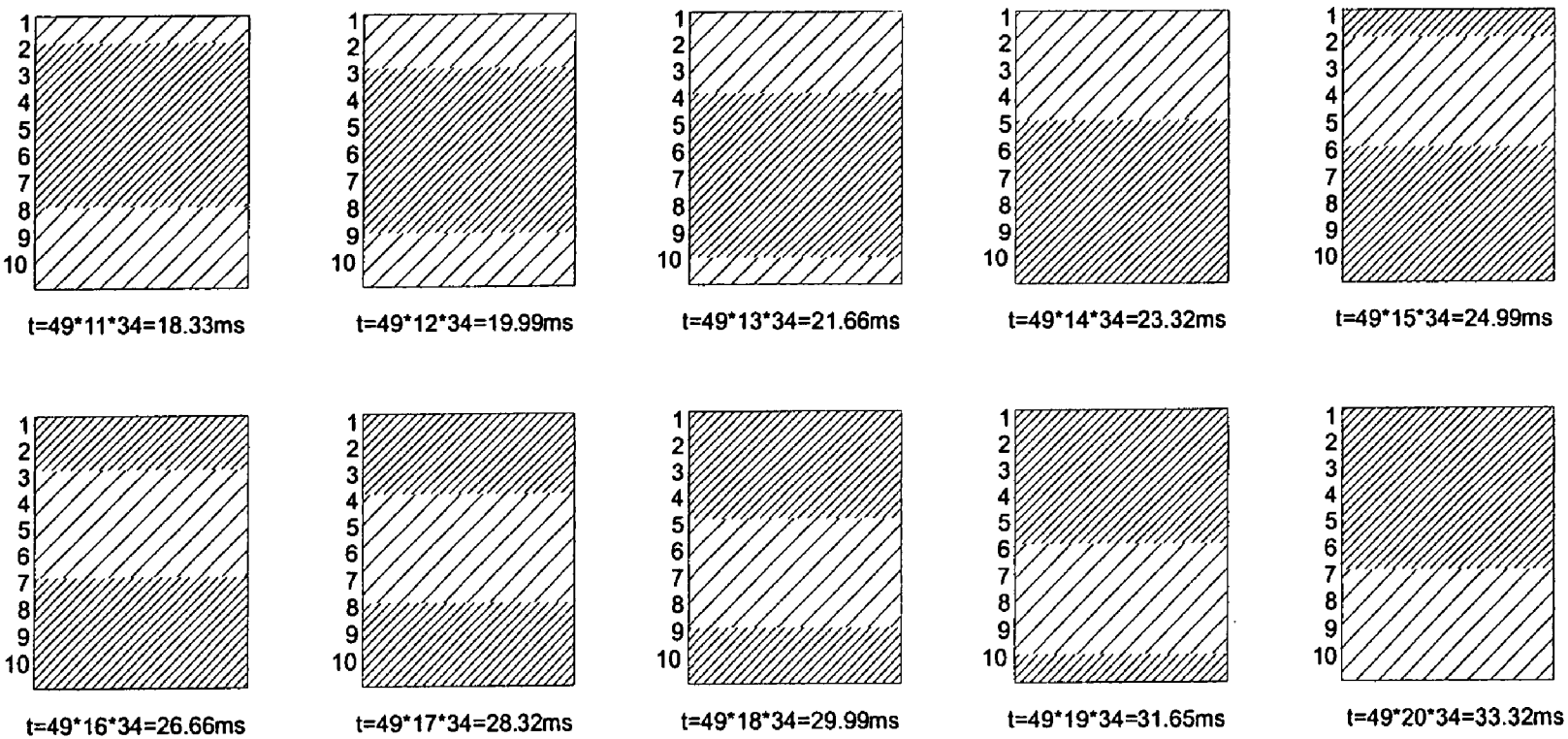
FIG. 7B is a display sequence diagram showing pixel images and black images displayed on the liquid crystal display of FIG. 6A at different times.

FIG. 7B shows a sequence of image frames on the liquid crystal display 600 (FIG. 6A), each showing pixel images and black images. In this example, m=10 and k=48. In each image frame, the sparser slanted lines represent the pixel images, and the denser slanted lines represent the black image. The left side of each image frame is labeled from 1 to 10, representing different display blocks 612. By inserting black images when driving the liquid crystal display, an effect similar to that of a CRT display mode can be achieved.

THE SECOND EXAMPLE

Figure 8:
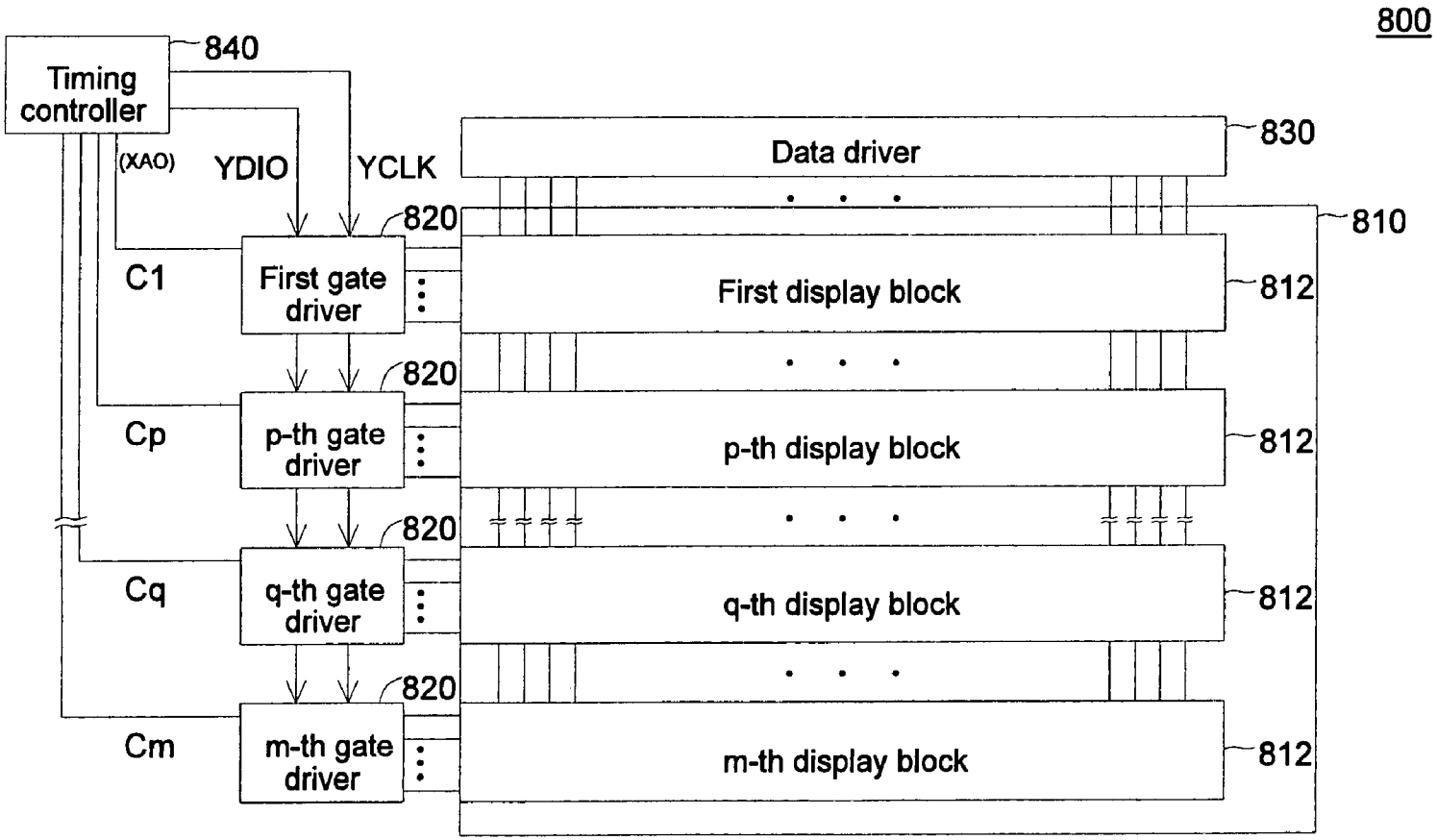
FIG. 8 is a block diagram of the structure of a liquid crystal display.

FIG. 8 shows a block diagram of the structure of a second example of a liquid crystal display. The liquid crystal display 800 includes an active display area 810 having m display blocks 812, m gate drivers 820, a data driver, and a timing controller 840. The m display blocks 812 include a first display block 812, . . . , and an m-th display block 812. Each display block 812 includes k pixel rows (not shown in the figure), in which m and k are positive integers larger than 1. The m gate drivers 820 include a first gate driver 820, . . . , and an m-th gate driver 820, for sequentially outputting k gate signals Gij (I=1~m, j=1~k) according to a clock signal YCLK and a driving signal YDIO.

The k gate signals Gij from the 1$^{st}$ to m-th gate drivers 820 drive the 1$^{st}$ to k-th pixel rows of the first display area 812, . . . , and the 1$^{st}$ to k-th pixel rows of the m-th display area 812, respectively, to receive pixel data output from the data driver 830 to display pixel images. The first gate driver 820, . . . , and the m-th gate driver 820 can also receive control signals Ci (i=1~m) output by the timing controller 840. When a gate driver receives the control signal Ci, the gate driver simultaneously outputs k dummy gate signals to drive all the pixel rows of the corresponding display block 812 to receive data from the data driver 830 to display a compensation image.

As shown in FIG. 8, after the p-th (p=1~m) gate driver 820 sequentially outputs the gate signal Gpj (j=1~k) to drive the k pixel rows of the p-th display block 812 to display images according to the signals YCLK and YDIO, the timing controller 840 outputs the control signal Cq to control the q-th (q≠p) gate driver 820 to simultaneously output k dummy gate signals for activating all the pixel rows of the q-th display block 812 to receive compensation signals, such as zero gray level voltage signals, that are output from the data driver 830 and display black images.

As described above, if the interval between the time when the first pixel row of the p-th display block 812 receives the gate signal Gp1 to display pixel images, and the time when the p-th gate driver receives the control signal Cp from the timing controller 840 to cause all the pixel rows of the p-th display block 812 to be turned on simultaneously to display a black image, is equal to one-half of the time required for displaying a complete image frame on the entire active display area 810, the duty ratio is about 50%. If the interval between the time when the first pixel row of the p-th display block 812 receives the gate signal Gp1 to display pixel images, and the time when the p-th gate driver receives the control signal Cp from the timing controller 840 to cause all the pixel rows of the p-th display block 812 to be turned on simultaneously to display a black image, is equal to ⅘ of the time required for displaying a complete image frame on the entire active display area 810, the duty ratio is about 80%. Therefore, the duty ratio can be selected according to the requirements for improving motion image quality.

According to the requirements for improving motion image quality, the compensation images can be inserted into different display blocks in a non-regular manner. Alternatively, after one of the pixel rows in one display block displays pixel images, a compensation image can be displayed in another display block. The active display area can be divided into display blocks, in which different display blocks have different numbers of pixel rows.

The examples of liquid crystal displays described above have several advantages. In the first example, the active display area can be divided into several display blocks, in which the blanking time can be distributed evenly among the display blocks. After the gate driver drives one display block to display pixel images, the gate driver can output a dummy gate signal during the blanking time to drive another display block to display a compensation image. In the second example, after one gate driver drives a corresponding display block to display pixel images, the timing controller can control another gate driver to drive another corresponding display block to display the compensation image. Thus, motion image quality can be improved to achieve an effect similar to the CRT display mode, without increasing the operational frequency of the gate driver and the data driver (thus preventing EMI problems that may result from the increased operational frequency), without increasing production costs, and without reducing the pixel aperture ratio.

Although some examples have been discussed above, other implementation and applications are also within the scope of the invention, as defined by the following claims.

What is claimed is:

1. A display comprising:

an active display area comprising a plurality of display blocks, each display block comprising a plurality of pixel rows;

a gate driver for sending a plurality of normal gate signals to the display blocks to drive corresponding pixel rows to display a normal image, the gate driver also sending a dummy gate signal to each display block to simultaneously drive the pixel rows of the display block to display a compensation image; and a plurality of multiplexers, wherein each multiplexer sequentially outputs the normal gate signals to pixel rows of a corresponding display block and outputs dummy gate signals for all the pixel rows of the corresponding display block;

wherein each multiplexer comprises a plurality of transistor sets for driving the pixel rows of the corresponding display block, each transistor set comprising a first transistor and a second transistor, in which the gate of the first transistor receives one of the normal gate signals, and the gate of the second transistor receives the dummy gate signal.

2. The display of claim 1, wherein after pixel rows of one display block receive corresponding normal gate signals to display the normal image, the pixel rows of another display block receive a corresponding dummy gate signal to display the compensation image.

3. The display of claim 1, wherein the transistors are NMOS transistors, and each normal gate signal and dummy gate signal provides high level voltages.

4. The display of claim 1, wherein the active display area comprises m display blocks, each display block comprising k pixel rows, m and k being positive integers larger than 1, and wherein after the gate driver generates normal gate signals to drive a p-th display block, the gate driver generates a dummy signal to drive a $\{mod((p+i),m)+1\}$-th display block, $1 \leqq p \leqq m$, $1 \leqq i < m$, p and i being positive integers.

5. The display of claim 1, wherein each dummy gate signal drives the pixel rows of a display block to receive a zero gray level voltage signal from a data driver.

6. The display of claim 1, wherein each dummy gate signal drives a display block during a blanking time.

7. A display comprising:

an active display area comprising a plurality of display blocks, each display block comprising a plurality of pixel rows;

a gate driver for sending a plurality of normal gate signals to the display blocks to drive corresponding pixel rows to display a normal image, the gate driver also sending a dummy gate signal to each display block to simultaneously drive a plurality of gate lines of the pixel rows of the display block to display a compensation image; and a plurality of multiplexers each to sequentially output the normal gate signals to pixel rows of a corresponding display block and output dummy gate signals for all the pixel rows of the corresponding display block;

wherein each multiplexer comprises a plurality of transistor sets for driving the pixel rows of the corresponding display block, each transistor set comprising a first transistor and a second transistor, in which the gate of the first transistor receives one of the normal gate signals, and the gate of the second transistor receives the dummy gate signal.

8. The method of claim 7, wherein the transistors are NMOS transistors, and each normal gate signal and dummy gate signal provides high level voltages.

* * * * *